US011235925B1

(12) United States Patent
Sheth

(10) Patent No.: US 11,235,925 B1
(45) Date of Patent: Feb. 1, 2022

(54) COLLECTION BIN LOCKING ASSEMBLY WITH GRAVITY OPERATED RELEASE MECHANISM

(71) Applicant: Piyush Sheth, Porter Ranch, CA (US)

(72) Inventor: Piyush Sheth, Porter Ranch, CA (US)

( * ) Notice: Subject to any disclaimer, the term of this patent is extended or adjusted under 35 U.S.C. 154(b) by 215 days.

(21) Appl. No.: 16/726,594

(22) Filed: Dec. 24, 2019

Related U.S. Application Data

(60) Provisional application No. 62/882,528, filed on Aug. 4, 2019, provisional application No. 62/828,484, filed on Apr. 3, 2019.

(51) Int. Cl.
*B65F 1/16* (2006.01)
*E05B 15/00* (2006.01)

(52) U.S. Cl.
CPC ..... *B65F 1/1615* (2013.01); *E05B 15/0093* (2013.01)

(58) Field of Classification Search
CPC . B65F 1/1615; E05B 15/0093; E05B 65/5292
USPC ..... 220/908
See application file for complete search history.

(56) References Cited

U.S. PATENT DOCUMENTS

| | | | |
|---|---|---|---|
| 3,954,172 | A | 5/1976 | Rinella |
| 4,155,584 | A | 5/1979 | Pracchia |
| 5,004,114 | A | 4/1991 | Terbrusch et al. |
| 5,015,021 | A | 5/1991 | Wyson et al. |
| 5,078,295 | A | 1/1992 | Grant |
| 5,094,487 | A | 3/1992 | Drewry |
| 5,149,153 | A | 9/1992 | Drewry et al. |
| 5,224,744 | A | 7/1993 | Michelutti |
| 5,474,341 | A | 12/1995 | Putman et al. |
| 5,683,126 | A | 11/1997 | De Vivo et al. |
| 5,758,914 | A | 6/1998 | Ioveno |

(Continued)

FOREIGN PATENT DOCUMENTS

| | | | |
|---|---|---|---|
| AU | 2013205595 | A1 | 11/2014 |
| AU | 2015261627 | A1 | 6/2016 |

(Continued)

OTHER PUBLICATIONS

Machine-Generated English Translation of EP0698567 obtained at <https://translationportal.epo.org/emtp/translate?ACTION=description-retrieval&COUNTRY=EP&ENGINE=google&FORMAT=docdb&KIND=A1&LOCALE=en_EP&NUMBER=0698567&SRCLANG=de&TRGLANG=en&apikey=TSMqTfrVAvNtryGI8Qlfbozj8DnAGIqJ&PDF=pY7v1NVzJfCjAR7zCf8_AzofmMdzUijOTKQCZB7ABAbb4KrP4DZcJKgtXKCilFS2d8Vu23wgik5kJKDKRu8PVVGwpLQ0h9WdkGIsdzTmfsc>.

(Continued)

*Primary Examiner* — Mollie Impink
(74) *Attorney, Agent, or Firm* — Hanrahan Law Firm, P.A.; Benjamin M. Hanrahan

(57) ABSTRACT

A collection bin locking assembly with a gravity-actuated release mechanism is disclosed herein. The locking assembly includes a housing attached to the body of the bin and a separate cord support structure attached to the lid. When locked, a cord spans between a first cord support structure on the housing and the separate or second cord support structure on the lid. A pendulum is disposed within the housing which, due to gravity, automatically swings between a first, resting position and a second, unlocked positioned when the collection bin is moved from an upright position to an at least partially upended position. Furthermore, the first cord support structure includes a groove and, adjacent to the groove, a smooth, outwardly curved surface. When the pendulum swings, the cord is forced out of the groove and onto the adjacent smooth, outwardly curved surface where the cord will slip off, thereby unlocking the lid.

20 Claims, 15 Drawing Sheets

(56) References Cited

U.S. PATENT DOCUMENTS

| | | | |
|---|---|---|---|
| 5,772,061 | A | 6/1998 | Lowe |
| 6,290,093 | B1 | 9/2001 | Obriot et al. |
| 6,666,485 | B1 | 12/2003 | Moret |
| 6,722,709 | B2 | 4/2004 | Bergdoll |
| 7,070,064 | B1 | 7/2006 | Henry et al. |
| 8,459,487 | B2 | 6/2013 | Sharma et al. |
| 8,485,382 | B2 | 7/2013 | Raghunathan et al. |
| 8,810,361 | B2 | 8/2014 | Thukral et al. |
| 9,469,475 | B2 | 10/2016 | McDade et al. |
| 9,682,819 | B2 | 6/2017 | Reeb |
| 9,821,956 | B2 | 11/2017 | Wright |
| 9,856,058 | B1 | 1/2018 | Arthurs et al. |
| 9,856,079 | B2 | 1/2018 | Manssourian |
| 10,100,554 | B2 | 10/2018 | Michael et al. |
| 2006/0169696 | A1 | 8/2006 | Taylor |
| 2007/0209846 | A1 | 9/2007 | Wilson |
| 2011/0274525 | A1 | 11/2011 | Mercier et al. |
| 2014/0208813 | A1 | 7/2014 | Reeb |
| 2014/0238990 | A1 | 8/2014 | Banik et al. |
| 2015/0053684 | A1 | 2/2015 | Nussbaum et al. |
| 2015/0307273 | A1 | 10/2015 | Lyman |
| 2015/0350610 | A1 | 12/2015 | Loh |
| 2016/0257491 | A1 | 9/2016 | Manssourian |
| 2017/0081119 | A1 | 3/2017 | Blazer et al. |
| 2017/0166397 | A1 | 6/2017 | Reeb et al. |

FOREIGN PATENT DOCUMENTS

| | | | |
|---|---|---|---|
| CA | 2627207 | A1 | 9/2009 |
| DE | 202004009622 | U1 | 11/2004 |
| EP | 0698567 | A1 | 2/1996 |
| GB | 2295991 | A | 6/1996 |
| GB | 2503765 | | 1/2014 |

OTHER PUBLICATIONS

Machine-Generated English Translation of EP0698567 obtained at <https://translationportal.epo.org/emtp/translate?ACTION=description-retrieval&COUNTRY=DE&ENGINE=google&FORMAT=docdb&KIND=U1&LOCALE=en_EP&NUMBER=202004009622&SRCLANG=de&TRGLANG=en&apikey=TSMqTfrVAvNtryGI8QIfbozj8DnAGlqJ&PDF=5telS4gmd0jfBifxCceV2bRvoaBbWCBKLwoAszTGkY35F3jDIMsKOQtQWG7KCTISF1kyJOgRmevK18-1Zd4-9UJ4wd64LILA4P6wKD-LMidM>.

COLLECTION BIN LOCKING ASSEMBLY WITH GRAVITY OPERATED RELEASE MECHANISM

CLAIM OF PRIORITY/CROSS-REFERENCE TO RELATED APPLICATION

The present application is based on and a claim of priority is made under 35 U.S.C. § 119(e) to provisional patent application Ser. No. 62/882,528, filed on Aug. 4, 2019, the contents of which are incorporated herein in their entirety by reference.

The present application is also based on and a claim of priority is also made under 35 U.S.C. § 119(e) to provisional patent application Ser. No. 62/828,484, filed on Apr. 3, 2019, the contents of which are also incorporated herein in their entirety by reference.

FIELD OF THE INVENTION

The present invention is generally directed to a trash or collection bin locking assembly, and more specifically to a gravity-operated, pendulum-based locking assembly configured to automatically unlock when the trash or collection bin is upended, for example, when the contents of the trash or collection bin are emptied by an automated garbage collection truck.

BACKGROUND OF THE INVENTION

Municipal collection bins, such as trash bins, solid waste bins, recyclable bins, and green waste bins are often required for use in many residential and commercial municipalities. For example, many municipalities use automated garbage collection trucks to collect garbage, trash, rubbish, recyclable materials, and yard waste from residential and commercial locations by operating an automated arm mechanism that extends from the truck, grabs around the collection bin, at least partially upends (inverts) the collection bin by lifting it up and flipping it at least partially over, and then replaces the collection bin to the curb or other location.

The trash or collection bins are susceptible to being blown open by strong winds, for example, but not limited to during wind storms, hurricanes, oceanic winds, low pressure zones in valleys and mountain tops, etc. These winds can blow open the lid of the collection bin allowing the waste or other materials disposed therein to scatter around and generate a mess in the corresponding residential or commercial area. In addition, small animals, such as raccoons and skunks, open and enter the collection bins while making a mess. Open trash or collection bins can also cause infestation of insects and vermin.

While some trash bin locks are known, there are no good economical solutions to keep trash or other collection bins closed and secure while at the same time allowing disposal of the contents by an automated garbage collection truck. For example, many locks are heavy or made of metal and other heavy materials. However, the trash collection process is violent, meaning that when the automated garbage collection truck upends the bin and returns the bin to the curb, there is a violent and forceful interaction between the truck and the bin. This can cause parts of the heavy locks to fly off of the bin, causing dangerous projectiles and potentially damaging property or injuring someone nearby.

Accordingly, there is a need in the art for a locking assembly that can be retrofitted on existing trash or other collection bins or integral therewith, and which uses gravity to automatically disengage during the garbage collection process.

It would also be beneficial if the proposed locking assembly is operable with trash or collection bins that are overfilled, or otherwise, trash or collection bins that a filled to a point where the lid is not able to fully close. In either case, e.g., whether the trash or collection bin is or is not overfilled, the proposed locking assembly should prevent or restrict trash from being scattered around externally to the bin.

SUMMARY OF THE INVENTION

Accordingly, the present invention is generally directed to a locking assembly for locking a collection bin lid to a collection bin body, and which includes a gravity-actuated or gravity-operated release mechanism. Specifically, the locking assembly of at least one embodiment includes a housing and at least one separate cord support or retention structure, both of which can be easily attached to the outside or external surface of the collection bin. In this manner, the locking assembly can be retrofitted to existing trash or collection bins, for example, by a homeowner, business owner, or a distributor or retailer of collection bins. In other embodiments, the present invention can be integral with or otherwise structurally part of the collection bin.

Furthermore, the locking assembly includes a pendulum which may be positioned within the housing, or in the case of the integral embodiment, within the body of the collection bin. The pendulum is pivotally disposed between a first, resting position and a second, unlocked positioned. Specifically, when the collection bin is upright and placed on a flat surface, gravity will cause the pendulum to be disposed in the first, resting position. When the collection bin is at least partially upended or inverted, for example, via an automated garbage collection truck, the pendulum will automatically swing or pivot into the second, unlocked position.

Attached to or otherwise movable with the pendulum is a first cord support structure or knob. The first cord support structure of at least one embodiment includes a groove on a portion thereof, e.g., on an undersurface or lower surface of the structure when the pendulum is in the first, resting position. Adjacent to the groove is a smooth, outwardly curved surface, which, as described herein, will help facilitate the automated gravity-operated release of the lock.

Specifically, a cord is disposed between the two cord support structures, and in at least one embodiment includes a looped configuration such that the cord loops around each of the two cord support structures. When the pendulum is pivoted from the first, resting position to the second, unlocked position, e.g., when the collection bin is upended, the cord will at least partially exit or otherwise at least partially disengage from the groove of the first cord support structure, and at least temporality contact the smooth, outwardly curved surface adjacent the groove until the cord is disengaged or otherwise slips from the first cord support structure. With the cord disengaged or removed from the first cord support structure, the lid of the collection bin is free to open from the force of gravity.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
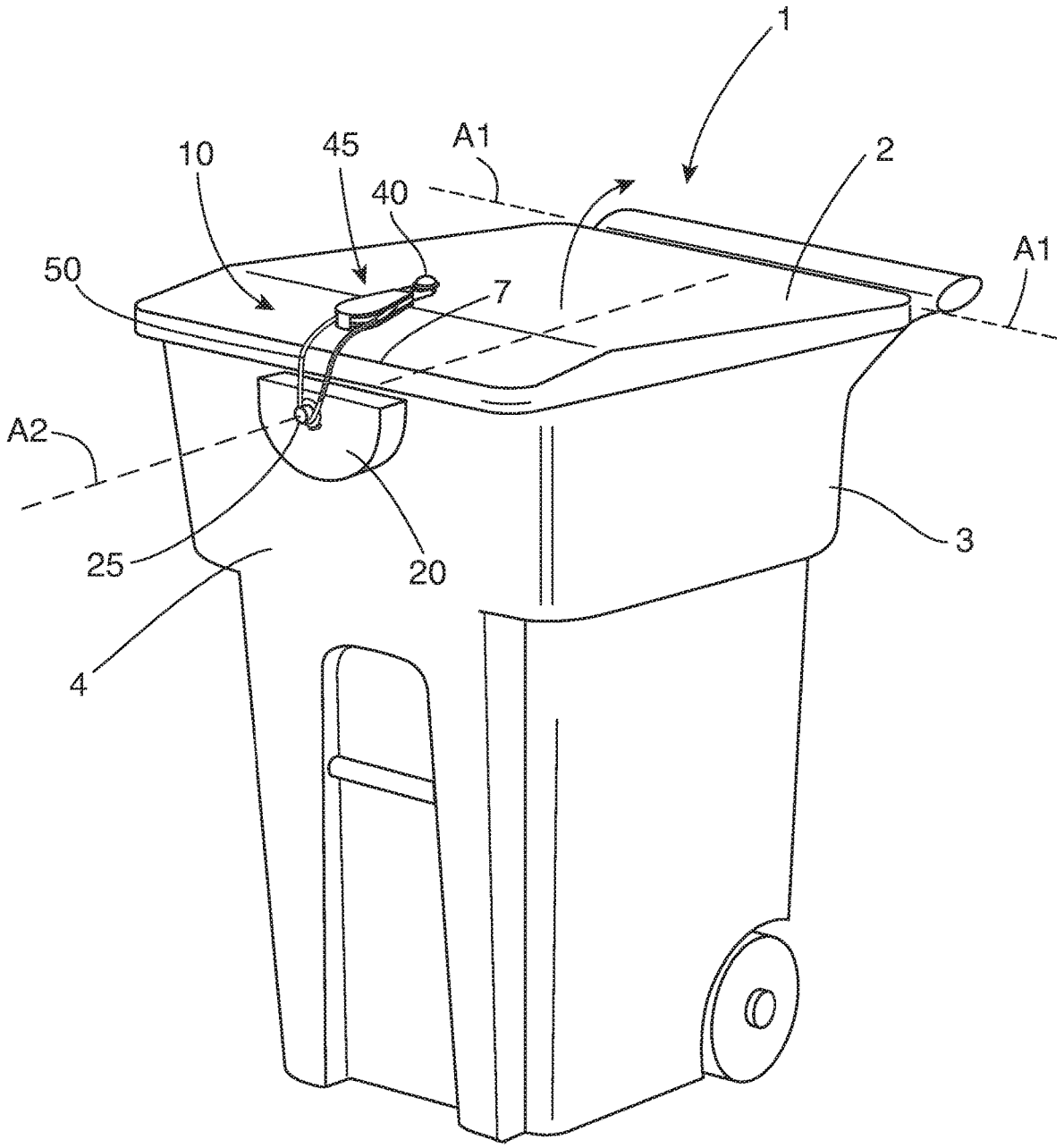
FIG. 1A is a perspective view of an exemplary collection bin and locking assembly disposed in a locked orientation as disclosed in accordance with at least one embodiment of the present invention.
Figure 2A:
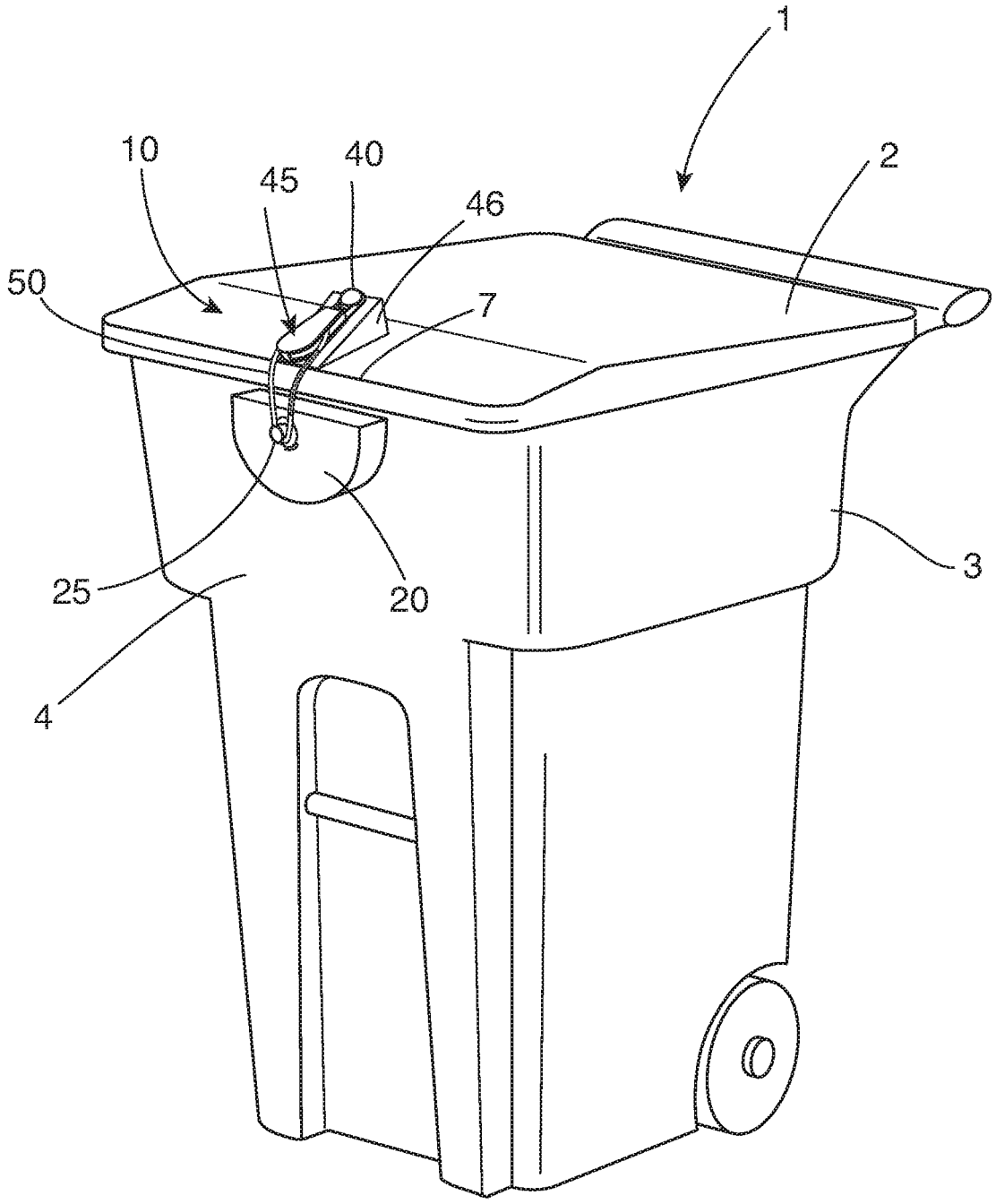
FIG. 2A is a perspective view of an exemplary collection bin and locking assembly disposed in a locked orientation as disclosed in accordance with another embodiment of the present invention.

As shown in the accompanying drawings, and with particular reference to FIGS. 1A and 2A, the present invention is directed to a trash bin locking assembly, generally referenced as 10, with a gravity-operated release mechanism. In particular, as is apparent from the description provided herein, the locking assembly 10 is able to secure and hold the lid 2 of a trash bin 1 to the main body 3 thereof, whereas the locking assembly 10 will automatically release upon the trash bin 1 being upended, for example, by an automated garbage collection truck. In some embodiments, the locking assembly 10 is able to secure the lid 2 to the body 3, even in situations where the trash bin 1 is overfilled, during windy conditions or inclement weather, etc.

For instance, many municipalities use automated garbage collection trucks to collect garbage, trash, rubbish, recyclable materials, and yard waste from residential and commercial locations by operating an automated arm mechanism that extends from the truck, grabs around the trash or collection bin 1, upends the bin by lifting it up and flipping it at least partially over, and then replaces the bin 1 to the curb or other location. FIG. 1A illustrates an exemplary trash or collection bin 1 operable with an automated garbage collection truck, although the present invention is in no way limited to the bin 1 illustrated in FIG. 1A (or any other figure herein), or to bins 1 that are operable with automated garbage collection trucks. Rather, the locking assembly 10 disclosed in accordance with the various embodiments herein may be used in connection with virtually any trash or other bin or receptacle. Furthermore, the terms trash bin and/or collection bin, as used herein, shall include bins or receptacles designated for trash, garbage, recyclable materials, yard waste, green waste, etc., and should not be construed as limited to trash, alone.

In any event, an exemplary collection bin 1 includes a main body 3 and a lid 1 pivotal about an axis, such as axis A1. In particular, when the lid 2 is closed, pivoting the lid 2 about axis A1 in the direction of the arrow illustrated in FIG. 1A will open the lid 2 and provide access to the interior portion of the body 3. Similarly, the lid 2 can be closed, or at least partially closed, by pivoting the lid 2 about the same axis A1 in the opposite direction until the lid 2 is in the closed position, as illustrated. It should be noted that, although in some instances, the body 3 of the trash or collection bin 1 may be overfilled in a manner such that the lid 2 is unable to completely close. Either way, e.g., whether the lid 2 can or cannot completely close relative to the body 3 of the collection bin 1, the locking assembly 10 of at least one embodiment can still operate in the intended manner in that it can still secure the lid 2 down relative to the body 3 as far as possible or as desired.

Figure 1B:
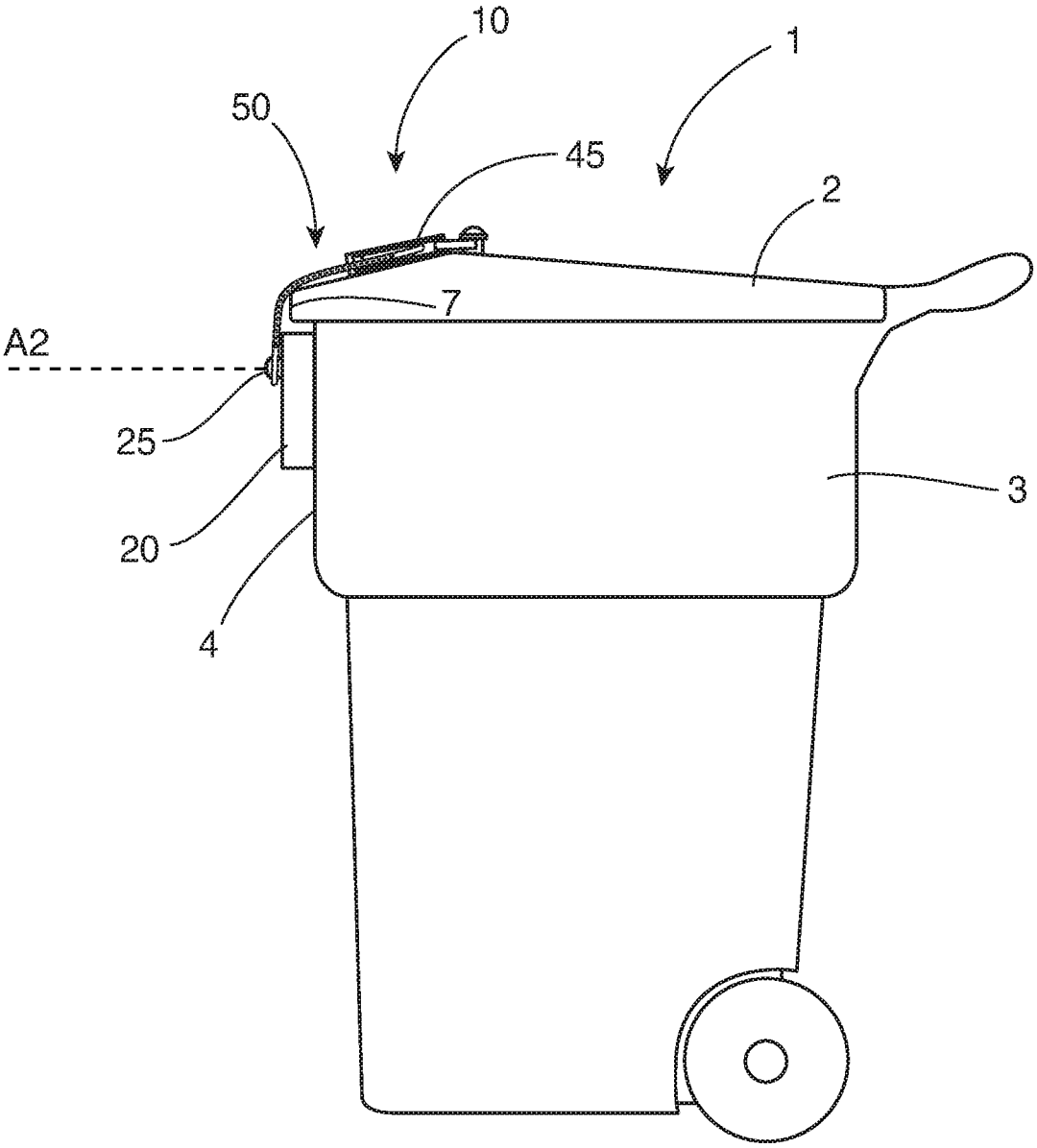
FIG. 1B is a side elevation view of the embodiment illustrated in FIG. 1A.

Moreover, and still referring to FIGS. 1A and 1B, at least one embodiment of the present invention includes a housing 20 secured, attached or affixed to a portion of the trash or collection bin 1, for example, but not limited to a front surface 4 of the bin 1. In some embodiments, the housing 20 may be made of a light plastic or recycled plastic, although other materials are contemplated. Further, although not shown in the drawings, the housing 20 may be secured to the bin 1 by way of a plurality of fasteners, such as screws, bolts, etc. In other embodiments, the housing 20 may be attached or connected to the bin 1 by adhesive, such as a glue, VELCRO® or other hook and loop type fasteners, snaps, clips, or any other fastening devices.

Furthermore, and still referring to FIGS. 1A and 1B, the locking assembly 10 of at least one embodiment includes a first support or retention structure 25 extending from the housing 10. A second support or retention structure 45 is secured or attached to another portion of the trash or collection bin 1, such as the lid 2, in a spaced relation from the first support or retention structure 25.

When the locking assembly 10 is disposed in the locked orientation, as represented in FIGS. 1A and 1B, a cord or cable 50 spans between the two support or retention structures 25, 45. The cord 50 is held taught between the two support or retention structures 25, 45, which is what maintains the lid 2 in the locked orientation, as represented in FIGS. 1A and 1B. As is apparent from the description provided herein, and as described in more detail below, when the trash or collection bin 1 is upended, for example, via an automated garbage collection truck 8 (with reference to FIGS. 9 and 11), the cord 50 will disengage from one of the support or retention structures, such as the first cord support structure 25, allowing the lid 2 to freely open, for example, by gravity.

Figure 3:
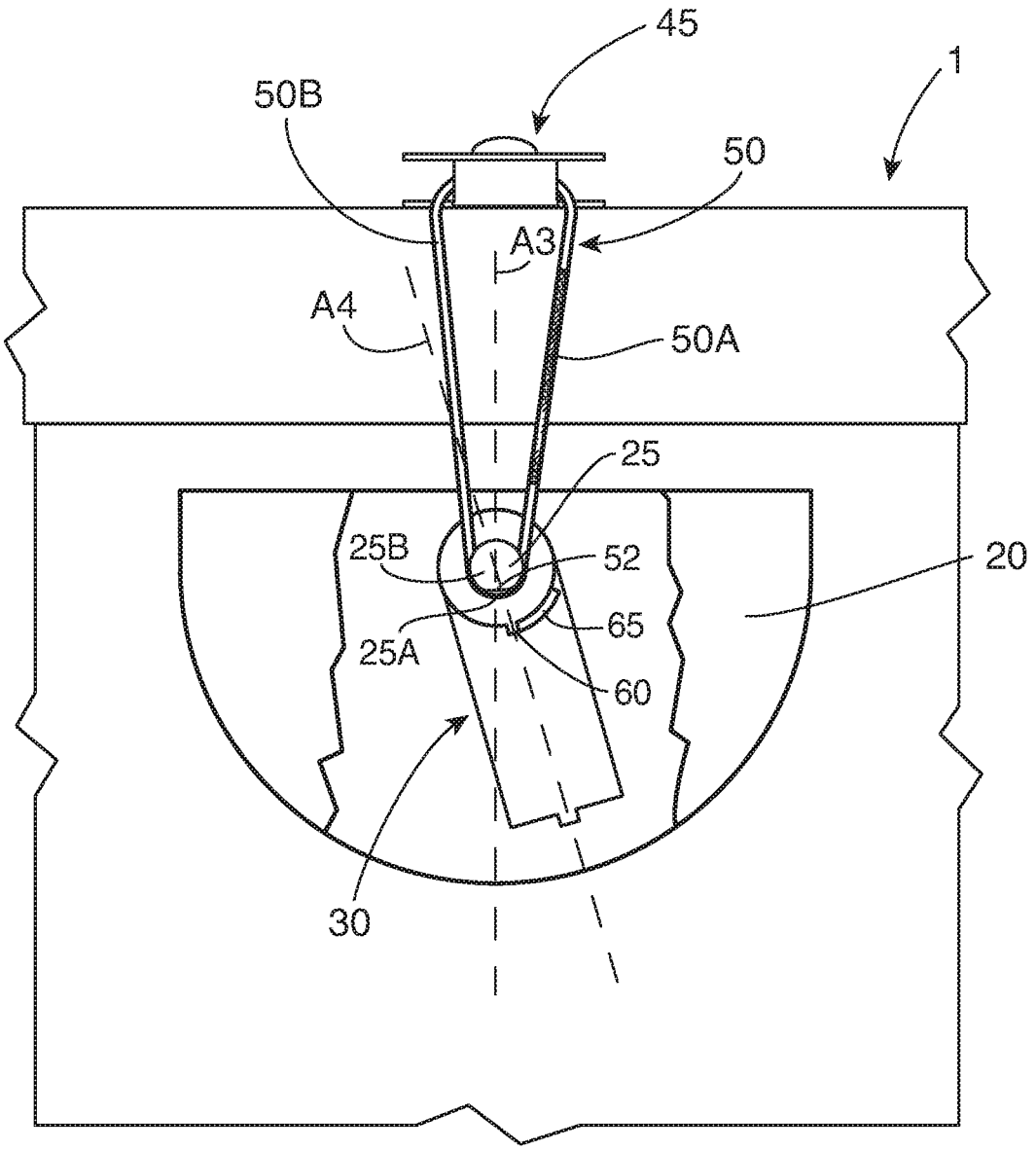
FIG. 3 is a close-up elevation and partial break-away view of the housing so that the pendulum of at least one embodiment is visible.
Figure 4:
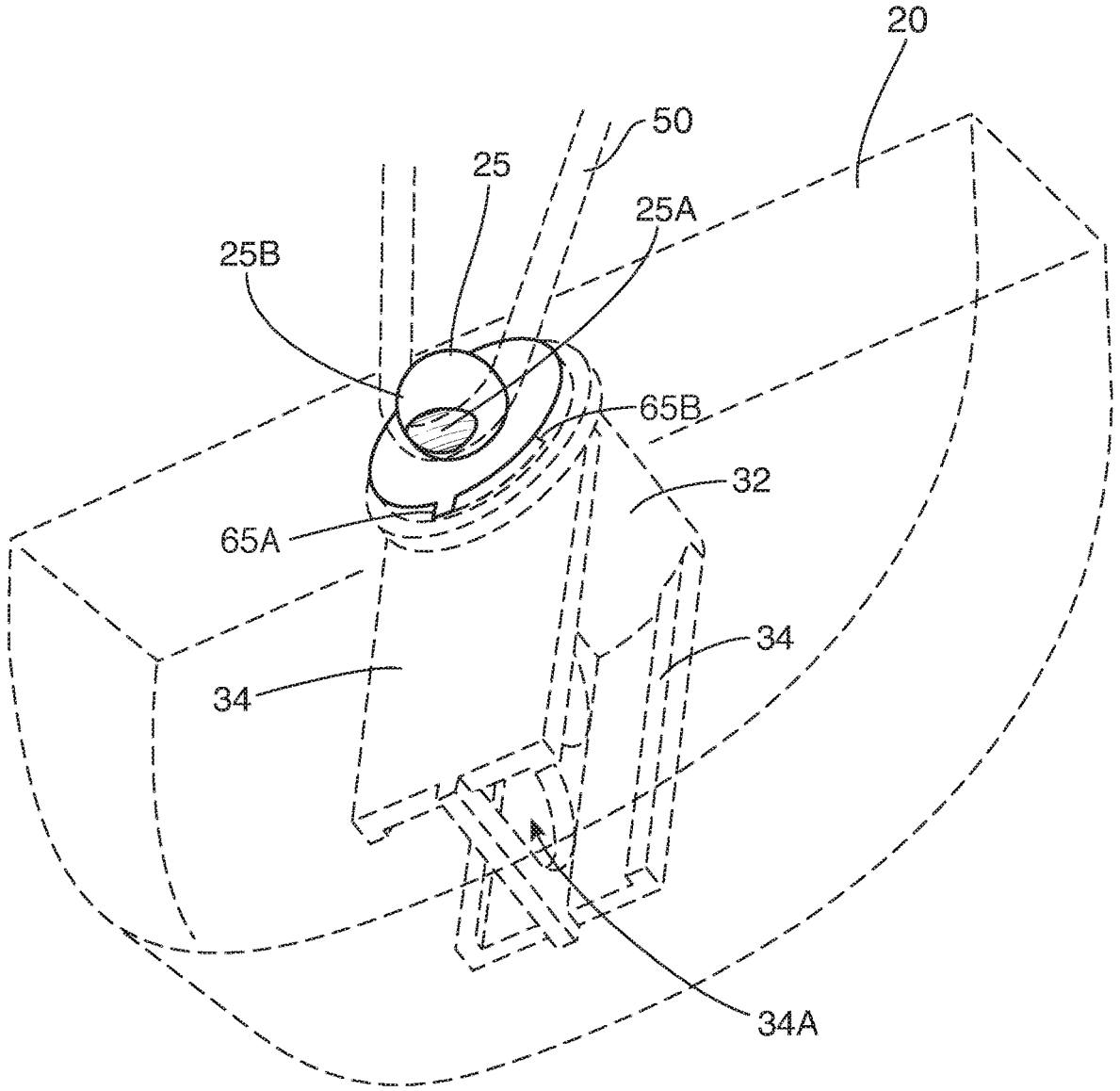
FIG. 4 is bottom perspective view of the housing illustrating the first cord support structure and groove disposed thereon as disclosed in accordance with at least one embodiment of the present invention.
Figure 5A:
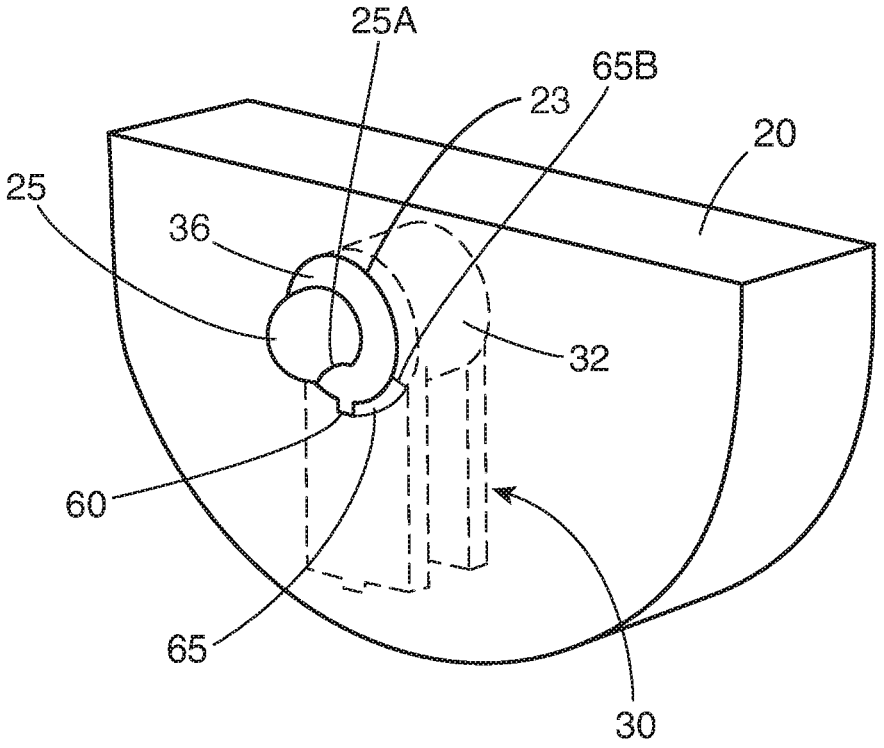
FIG. 5A is a perspective view of the housing and partial internal view thereof illustrating the pendulum disposed in the first, resting position, as disclosed herein.
Figure 5B:
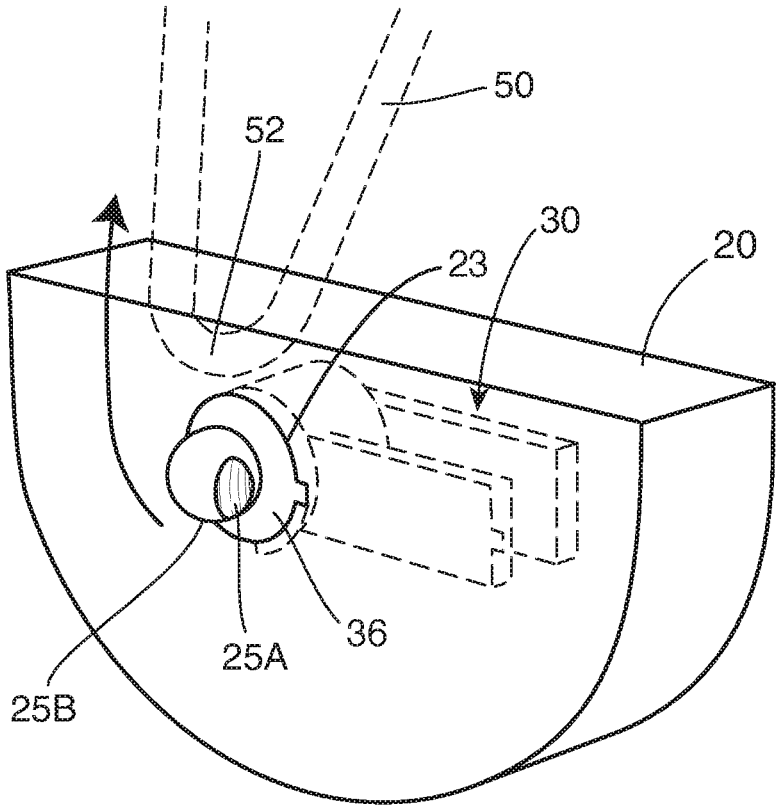
FIG. 5B is a perspective view of the housing and partial internal view thereof illustrating the pendulum disposed in the second, unlocked position, as disclosed herein.

In particular, with reference to FIGS. 3, 4, 5A and 5B, at least one embodiment of the present invention includes a pendulum 30 at least partially disposed on an interior portion 21 of the housing 20. The pendulum 30 is pivotal between a first, resting position, as shown in FIG. 3, for example, and a second, unlocked position, as shown in FIG. 5B. For example, the pendulum 30, of at least one embodiment of the present invention, includes a main body 32 and at least one leg 34 extending therefrom. With reference to FIG. 1A, the pendulum 30 has an axis of rotation shown as A2.

A weight (not shown) can be secured to the pendulum 30, for example, at or near a bottom end of the leg(s) 34. In some cases, the weight may be set or installed within hole or location 34A, although other locations are contemplated. In at least one embodiment, the user (e.g., the homeowner or business owner) may place his or her own weighted object upon the end of the pendulum 30, whereas in other embodiments a weight may come preinstalled, for example, by a manufacturer or distributor. In this manner, the weight or weights can come in virtually any form so long as they add weight to the end or near the end of the pendulum 30. As just an example, the weight can be a ball bearing, piece of metal, scrap metal, etc.

In at least one embodiment, the first support structure 25 is connected to the pendulum 30, for example, but not limited to, the main body 32 thereof, and is disposed external to the housing 20 so that the cord 50 can at least temporarily secure thereto, as described herein. In some embodiments, the first support structure 25 is a separate piece that is attached to the pendulum 30, while in other embodiments, the first support structure 25 is integral with the pendulum 30. In either case, there is at least one hole in the housing through which the first support structure 25 can extend.

Accordingly, the first support structure 25 of at least one embodiment is structured to move or pivot with the pendulum 30 as the pendulum 30 moves or pivots between the first, resting position and the second, unlocked position. In at least one embodiment, the first support structure 25 will rotate about the same axis of rotation A2 or pivot point upon which the pendulum 30 pivots or swings.

Referring now to FIGS. 4, 5A and 5B, the first support structure 25 of at least one embodiment includes a groove, notch or indentation 25A disposed on a portion thereof, e.g., on an undersurface or lower surface thereof. The groove 25A is configured to receive a portion of the cord 50 therein, for example, when the locking assembly 10 is disposed in the locked orientation. For instance, the groove 25A may have a width or configuration cooperatively structured to receive a portion of the cord 50 and to securely hold or retain the cord 50 therein. In this manner, the width of the groove 25A may be substantially the same as or larger than the thickness of the cord 50.

In one example, the cord 50 may have a looped configuration defining at least one bend 52. The bend 52 will loop around the first support structure 25 and engage within the groove 25A, at least when the locking assembly 10 is locked.

In at least one embodiment, immediately adjacent the groove 25A is a smooth, outwardly curved surface 25B. In this manner, as the pendulum 30 swings or pivots, and the first support structure 25 pivots or rotates, at least a portion of the cord 50, e.g., the bend 52 of the looped cord 50, will be forced at least partially out of the groove 25A and into contact with the adjacent smooth, outwardly curved surface 25B. When this happens, the cord 50 will slip off of the first support structure 25 as shown in FIG. 5B.

Accordingly, it should be noted that the smooth, outwardly curved surface 25B of the knob or first support structure 25 is defined as a rounded surface that curves away from the bend 52 causing the bend 52 to easily slip off. Also, the smooth, outwardly curved surface 25B of at least one embodiment is adjacent the groove 25A in the opposite direction of rotation of the first support structure 25. More specifically, with reference to FIG. 3, the first support structure 25 in this example will rotate in a counter-clockwise direction. Accordingly, the smooth, outwardly curved surface 25B is located to the left or in a clockwise direction from the groove 25A. This ensures that when the first support structure 25 rotates in the counter-clockwise direction (in this non-limiting example), the bend 52 of the cord 50 will be sure to engage or contact the smooth, outwardly curved surface 25B and slip off.

Furthermore, in the illustrated and exemplary embodiment, the first support structure 25 has a partially spherical shape, e.g., a hemispherical shape, with an undercut groove 25A thereon within which the cord 50 can engage. Accordingly, the spherical, partially spherical or hemispherical shape naturally includes a smooth, outwardly curved surface away from the bend 52, except where the groove 25A is disposed.

It should also be noted that in some embodiments, the cord 50 will rotate with the first support structure 25, whereas in other embodiments, the first cord support structure 25 will rotate relative to or substantially independent of the cord 50. This may depend on the friction between the cord 50 and the first support structure 25. For example, if the frictional force(s) between the cord 50 and the first support structure are great enough, as the first support structure 25 rotates, the cord 50 will rotate or at least partially rotate therewith. In some embodiments, however, the friction between the cord 50 and the first cord support structure 25 may be such that rotation of the first support structure does not cause rotation or movement of the cord 50. In other words, the first support structure 25 may rotate independent of the cord 50. In either case, rotation of the first cord support structure 25 will cause the cord 50 or the bend 52 in the cord 50 to exit or at least partially exit the groove 25, contact or at least partially contact the adjacent smooth, outwardly curved surface 25B and disengage from the first support structure 25.

Referring again to FIG. 1A, the second cord support structure 45 may be connected or secured to the trash or collection bin 1, for example, to the lid 2 of the trash or collection bin 1, via one or more fasteners 40, such as a screw, bolt, adhesive, snap, clip, hook and loop fasteners, etc. In the embodiment shown, the second support structure 45 is in the form of a pulley which may be at least partially movable relative to the lid 2 and the fastener 40. The cord 50 is fed or routed through the pulley as shown and then looped around the first support structure 25.

It should also be noted that the location of the second cord support structure 45 may depend on the configuration of the particular collection bin 1. For example, as shown in FIGS. 1A and 1B, the second cord support structure 45 is spaced a distance from the front edge 7 of the bin 1 with the cord 50 extending from the second cord support structure 45, over the edge 7 of the bin 1 and to the first cord support structure 25. If the cord 50 rubs against the front edge of the bin 1, it may deteriorate over time due to being rubbed against a corner or edge 7 of the bin.

In this manner, a guard or plate (not shown) may be attached to the bin 1 under the cord 50 (e.g., at the front edge or corner of the bin). The guard or plate would have a smooth surface, smoother than the corner or edge of the bin, or otherwise a surface with less friction that the surface or corner of the bin such that when or if the cord 50 contacts the guard or plate, less damage is caused to the cord over time.

It may also be desirable to mount the second cord support structure 45 closer to, adjacent to or substantially adjacent to the front edge or corner 7 of the bin 1. This may allow the cord 50 to extend between the first and second cord support structures 25, 45 with minimal or no contact with the bin 1, such as the front corner or edge 7, as illustrated in the embodiment shown in FIGS. 2A and 2B.

Furthermore, at least one embodiment may also include a base 46 to which the second cord support structure 45 will mount. It should be noted that the base 46 and the second cord support structure 45 may in some embodiments be separate pieces secured or attached to one another, although in other embodiments, the base 46 and second cord support structure 45 may be integrally constructed. Either way, the base 46 allows the second cord support structure 45 to be mounted in a position that minimizes or eliminates contact between the cord 50 and the front corner or edge 7 of the bin 1.

Figure 2B:
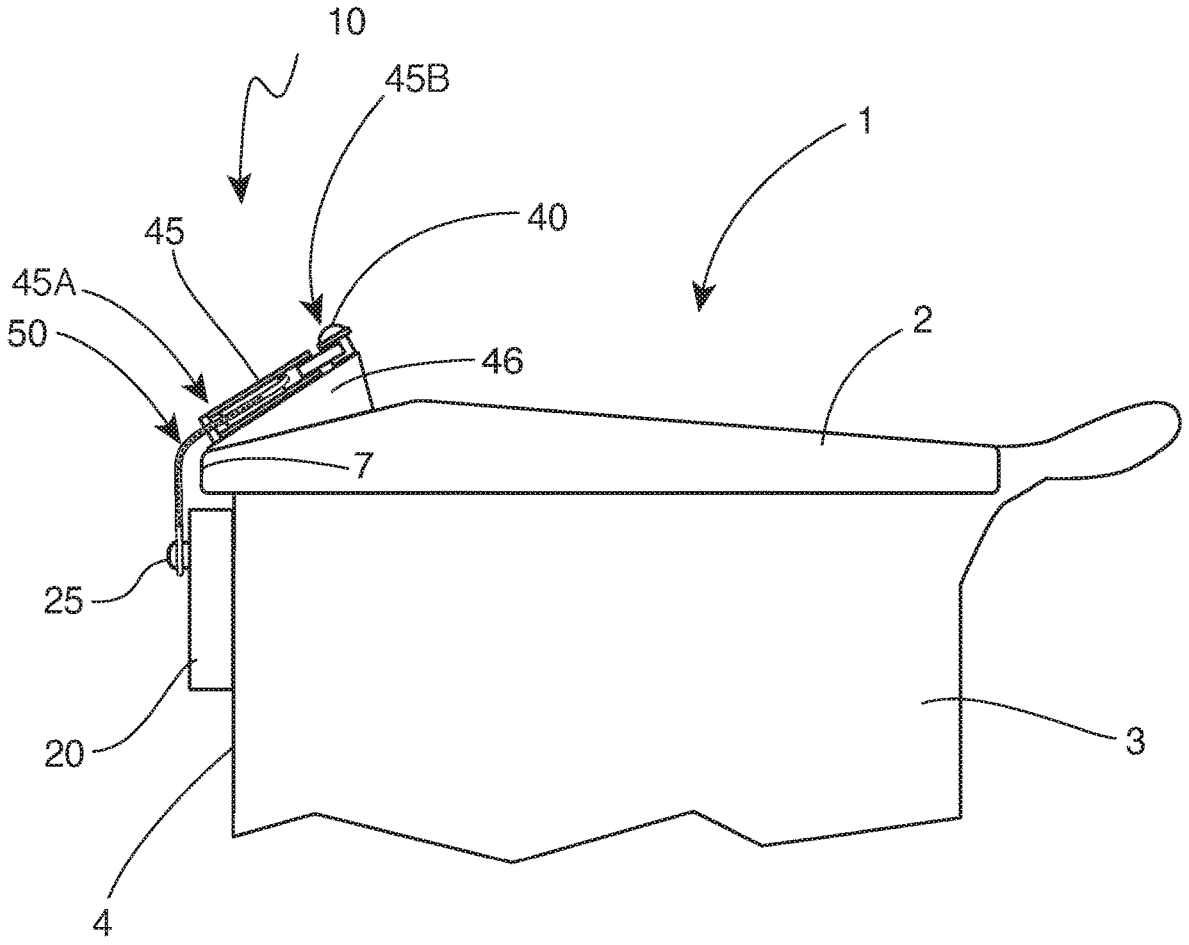
FIG. 2B is a partial side elevation view of the embodiment illustrated in FIG. 2A.

For example, in at least one embodiment, as shown in FIGS. 2A and 2B, the base 46 is in the form of a wedge that elevates one side, e.g., the rear portion 45B, of the second cord support structure 45 above the opposite side, e.g., the front portion 45A. This elevates and/or angles the cord support structure 45 and/or cord 50 relative to the top surface or lid 2 of the bin 1. Doing so, minimizes or eliminates contact between the cord 50 and the edge or corner 7 of the bin 1.

It should also be noted that other bases 46 or cord support structures 45 are contemplated that are configured to position the cord 50 in a manner such that the cord 50 does not contact the bin 1, such as the front edge or corner 7 of the bin 1 when the locking assembly is in the locked position, as illustrated in FIGS. 2A and 2B, for example. The wedge-shape of the base 46 or angular positioning of the second cord support structure or cord 50 relative to the lid 1 is exemplary.

Additionally, cord support structure 45 of at least one embodiment includes a pulley that may, but does not necessarily, include a wheel rotatable on an axel or shaft facilitating rotation of movement of the cord 50 lengthwise through the pulley. For example, in some embodiments, the need for the pulley of the second cord support structure 45 to be rotatable or otherwise the need for the pulley to have a rotatable wheel depends on the friction of the cord 50 or the coefficient of friction applied to the cord 50 within or upon the pulley 45. For example, if the cord 50 is able to slide on the pulley or second support structure 45 with the rotation or movement of the pendulum 25/30, then the pulley or second cord support structure 45 does not need to be rotatable. Similarly, if, as in one embodiment above, the first cord support structure 25 rotates independently of the cord 50, meaning that rotation of the first cord support structure 25 does not cause substantial movement of the cord 50, then the second cord support structure 45 does not necessarily need to be rotatable.

If, on the other hand, the cord 50 cannot or has difficulty sliding along the second cord support or pulley 45, for example, due to a frictional or resistance force, then the pulley of the second cord support structure 45 may need to have a rotatable wheel or other like rotatable portion in order to facilitate the movement of the cord 50 relative thereto.

In at least one embodiment, the cord 50 is at least partially encased within the second support structure 45 such that the cord cannot be fully separated from the second support structure 45. This can be beneficial in that loss of the cord 50, for example, during a trash removal process, is eliminated or minimized. In other embodiments, more simplistic support structures are contemplated, for example, without rotatable wheels and/or without movable parts. In other words, the second support structure 45 of at least one embodiment need not be a traditional pulley with a rotatable wheel, but may instead be a fixed knob within a housing to retain the cord therein.

Referring again to FIG. 3, in at least one embodiment, the pendulum 30 is angularly disposed relative to a vertical axis A3 when the pendulum 30 is disposed in the first or rested position. For example, when the trash or collection bin 1 is set on a flat surface, the longitudinal axis A4 of the pendulum will be slightly offset relative to the vertical axis A3. The longitudinal axis A4 is defined as the axis that passes longitudinally through the pendulum 30 from the top of the body through the bottom end of the leg(s).

Naturally, gravity would tend to cause the pendulum to be in a vertical, non-offset position at rest. Accordingly, in at least one embodiment, the locking assembly 10 includes a stopper or protrusion, referenced as 60 and a corresponding channel 65 within which the stopper is able to travel. For instance, in the embodiment illustrated, and with reference to FIGS. 5A and 5B, the pendulum includes a disc, base or surface 36 as part of or attached to main body 32, that rotates along with the movement of the pendulum 30 and the first support structure 25. In some embodiments, the housing 20 includes a hole or opening 23 through which or at which a portion of the pendulum 30, such as a portion of the main body 32 or surface 36, extend. The first cord support structure 25 is therefore attached, either directly or indirectly, to the surface 36 and disposed external to the housing 20.

The disc, base or surface 36 of at least one embodiment includes a stopper or protrusion 60 that fits within channel 65. Channel 65 does not move with the movement of the pendulum 30, first support structure 25 or disc 36. Accordingly, the channel 65 may be formed in the housing 20 and therefore stationary or substantially stationary relative to the pendulum.

In this manner, the channel 65 includes opposite ends 65A, 65B which restrict or prevent further rotational or pivotal movement of the pendulum 30. Specifically, when the pendulum 30 is in the first or resting position (e.g., FIGS. 3 and 5A), the stopper 60 of at least one embodiment will engage the first end 65A of the channel 65. The channel 65 and stopper 60 are configured in a manner such that when the pendulum 30 is disposed in the first or resting position, the longitudinal axis A4 of the pendulum 30 will be offset from the vertical axis A3 in the direction of travel or rotation. For example, with reference to FIG. 3, since the pendulum 30 in this example will swing or pivot from the first, resting position to the second unlocked position in a counter-clockwise direction, the pendulum is offset from the vertical axis in the direction of travel (e.g., in a counter-clockwise direction). This can ensure that when the trash or collection bin 1 is upended, gravity will cause the pendulum 30 to swing in the direction of travel. In other words, the offset position of the pendulum 30 in the resting position prevents or minimizes the situation where the pendulum 30 gets stuck in the vertical position. With the "head start," the pendulum 30 will have no problems swinging or pivoting when the trash or collection bin 1 is upended.

It should also be noted that in at least one embodiment, the pendulum 30 and/or the extended leg(s) thereof are offset between approximately fifteen and twenty five degrees from the vertical axis A3 in the direction of rotation, although other offset angles are contemplated within the full spirit and scope of the present invention.

Figure 9:
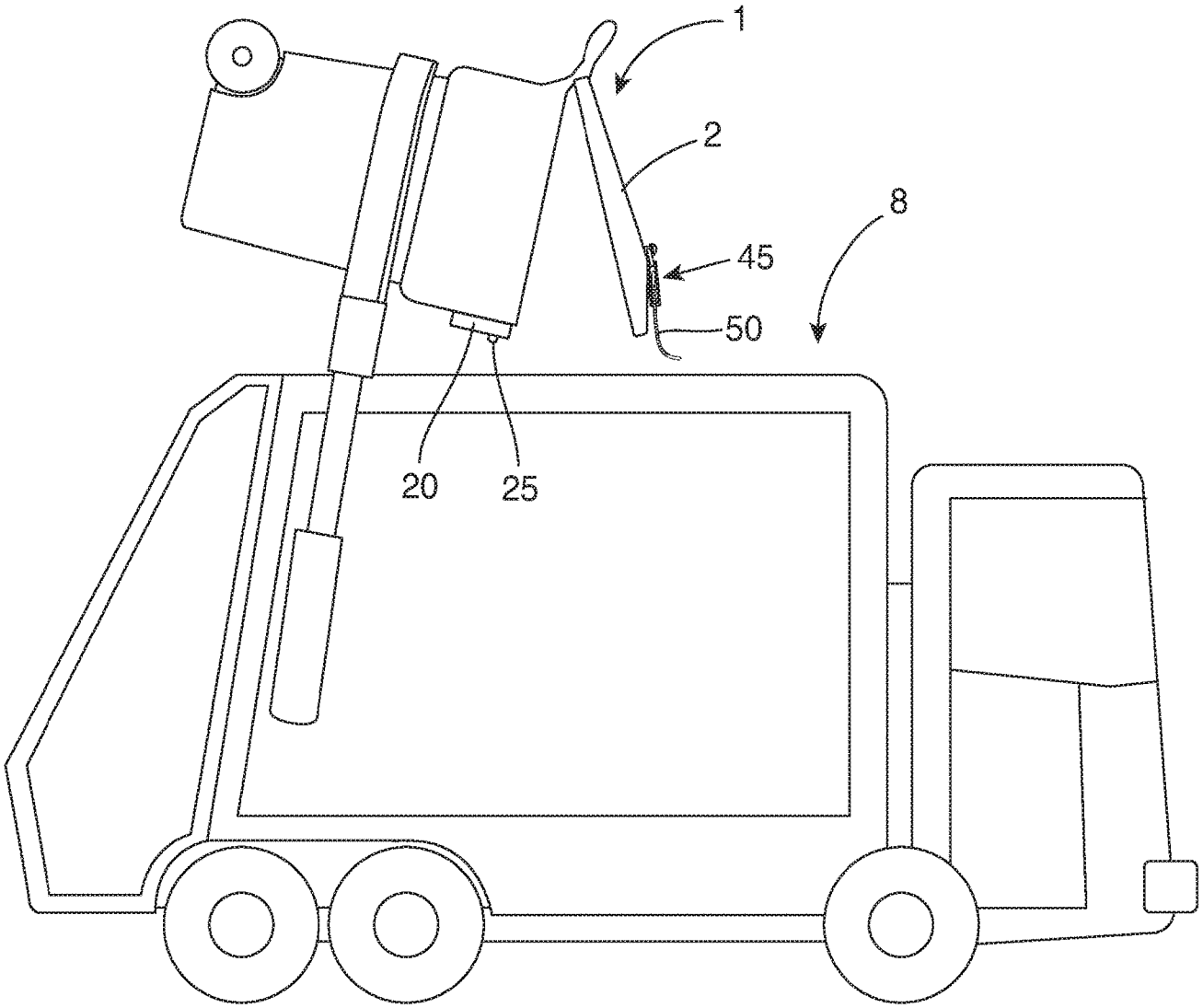
FIG. 9 is a side view of the automated garbage collection truck engaging an exemplary collection bin from the front, with the collection bin at least partially upended, and with the locking assembly disposed in the unlocked orientation due to gravity rotation of the pendulum.
Figure 10:
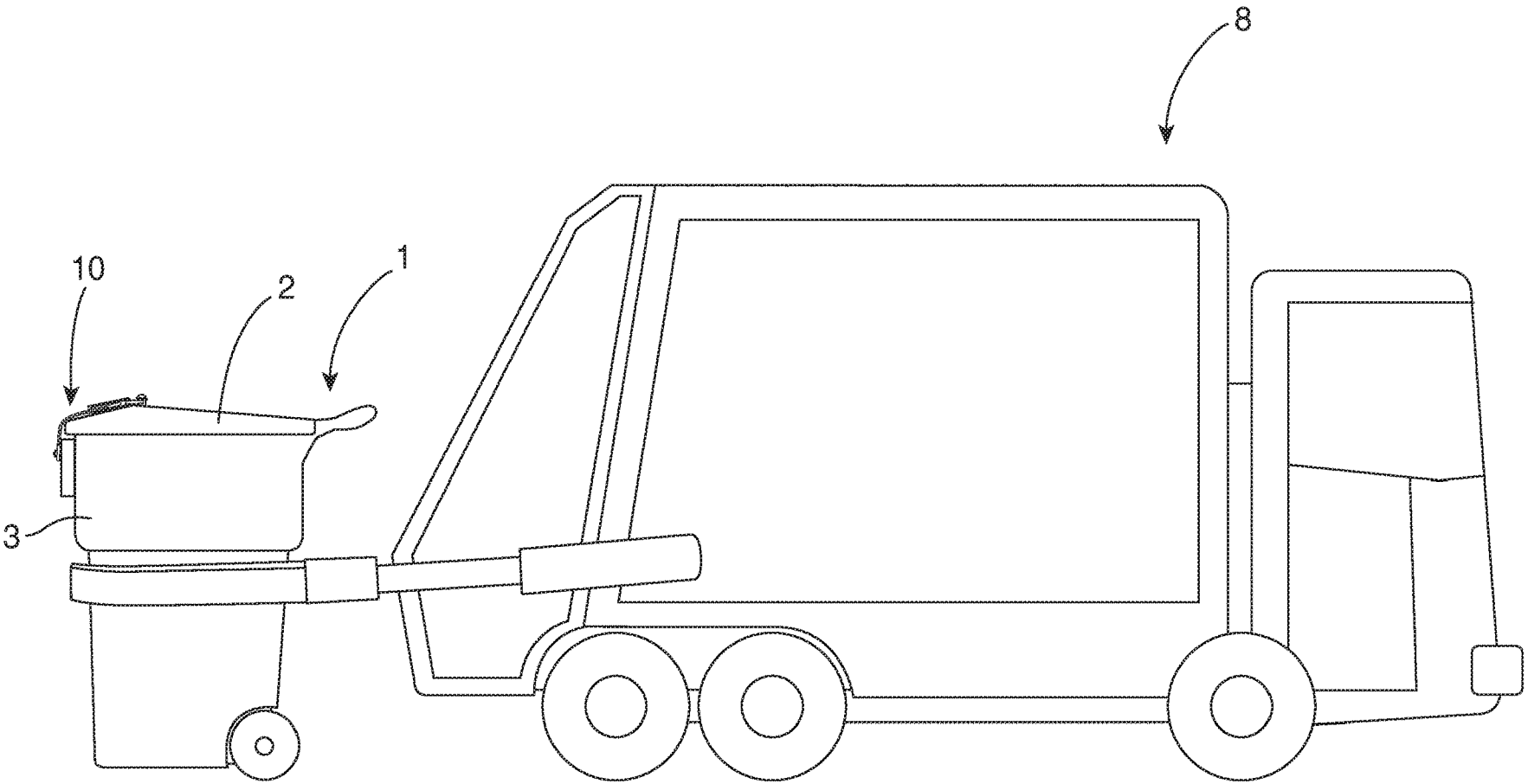
FIG. 10 is a side view of an automated garbage collection truck engaging an exemplary collection bin from the rear, with the locking assembly disposed in the locked orientation.
Figure 11:
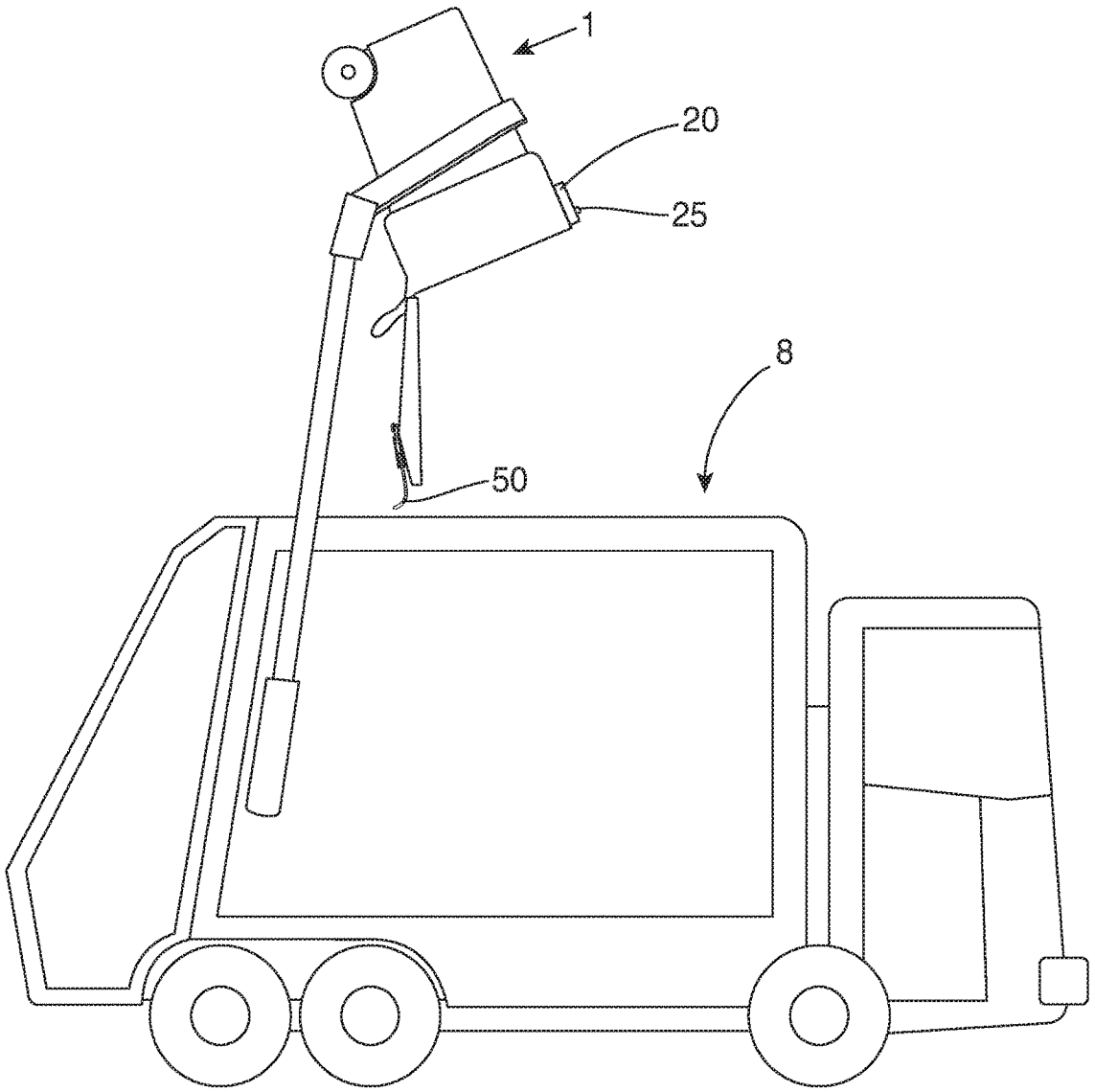
FIG. 11 is a side view of the automated garbage collection truck engaging an exemplary collection bin from the rear, with the collection bin at least partially upended, and with the locking assembly disposed in the unlocked orientation due to gravity rotation of the pendulum.

It should also be noted that the first, rested position is defined as the position of the pendulum 30 when the trash or collection bin 1 is disposed upright on a flat surface, as shown in FIGS. 1A, 1B, 2A, 2B, 3, 4, 5A, 5B, 6, 8 and 10. The second, unlocked position is defined as the position of the pendulum 30 when the trash or collection bin 1 is upended and the pendulum 30 has pivoted from its first, resting position and the cord 50 is disengaged from the first support structure 25. In some cases, this is when the stopper 60 reaches end 65B of channel 60, although it could be sooner in the rotation path. Examples of the pendulum 30 in the second, unlocked position are shown in FIGS. 5B, 9 and 11.

In this manner, the channel 65 of at least one embodiment defines the angular range upon which the pendulum 30 can swing or pivot, meaning that the stopper 60 and channel 65 restrict movement of the pendulum 30 to a predefined angular range. In one embodiment, that predefined angular range is between sixty and seventy degrees, although other ranges higher or lower are contemplated within the full spirit and scope of the present invention.

Figure 6:
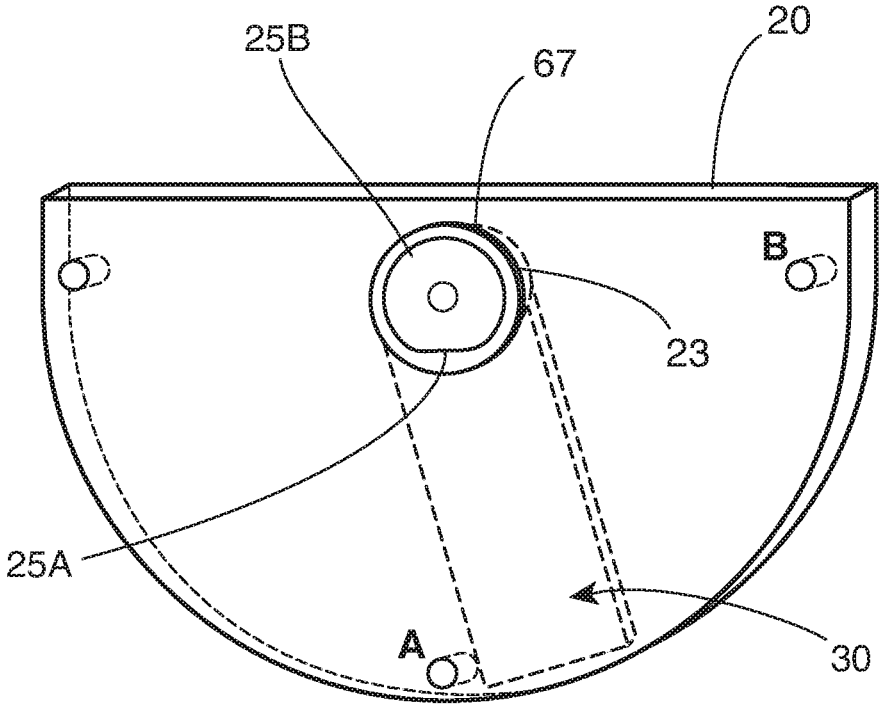
FIG. 6 is a partial perspective and phantom view of the housing and pendulum as disclosed in accordance with another embodiment of the present invention.

Referring now to FIG. 6, another exemplary embodiment of the pendulum 30 is shown. In this embodiment, at least one stopper, e.g., stopper A, is provided within housing 20 or otherwise along the swinging path of pendulum 30. The stopper A is fixed structured to restrict movement of pendulum 30 past the stopper A. Furthermore, stopper A is positioned in a manner such that the pendulum 30 will or can engage or contact the stopper A when the pendulum 30 is in the first, resting position, as mentioned above. In at least one embodiment, the stopper A is disposed in a position such that when the pendulum 30 engages or contacts the stopper A in the resting position, the pendulum 30 is disposed in an angular or offset position as described above with reference to FIG. 3.

In at least one embodiment, and still referring to FIG. 6, a second stopper B is shown. Stopper B is fixed and disposed along the swinging path of pendulum 30. Stopper B restricts further movement of pendulum 30 past stopper B. When the pendulum engages or contacts stopper B, the pendulum 30 of at least one embodiment is disposed in the second position, which, as described above, causes the cord 50 to disengage and locking assembly to become unlocked.

As shown in FIGS. 6 and 7A through 7C, it should be noted that in some embodiments, a bearing structure, referenced as 67, is disposed at least partially around the opening 23 of the housing 20 through which a portion of the pendulum 30 (e.g., a portion of main body 32) passes such that the first cord support structure 25 is disposed external to the housing 20. For instance, as mentioned above, in some embodiments, the housing 20 includes a hole or opening 23 through which or at which a portion of the pendulum 30, such as a portion of the main body 32 or surface 36, extend. The first cord support structure 25 is therefore attached to the pendulum 30, e.g., either directly or indirectly to the surface 36 and disposed external to the housing 20. In other words, the opening 23 allows the first cord support structure 25 to be attached or connected to the pendulum 30 while the first cord support structure 25 is at least substantially external to the housing 20 and the pendulum 30 is substantially or at least partially inside of the housing 20. Thus, some embodiments include a bearing structure 67 disposed around the outer edge of the opening 23 between the edge of the opening and the portion of the pendulum that extends to or in some cases through the opening 23. The bearing structure 67 is to facilitate pivotal movement of the pendulum 30 between the first and second positions described herein.

For example, bearing structure 67 may include a ball bearing other similar device structured to minimize frictional resistance between the pendulum 30 and the housing 20, allowing the easily pendulum 30 to rotate or pivot relative to the housing 20, as described herein, and with little to no friction there between. More specifically, as shown in the cross-section view of FIG. 7C, the bearing structure 67 may include an outer circumferential surface 67A that is attached to or fixed to the edge defining opening 23 of the housing 20. In some embodiments, the outer circumferential surface 67A is attached or fixed to the housing 20 at opening 23, for example, via adhesive, glue, silicone, etc. Similarly, inner circumferential surface 67B of the bearing structure 67 of at least one embodiment is attached or fixed to pendulum 30, for example, via adhesive, glue, silicone, etc.

It should be apparent that inner circumferential surface 67B is configured to rotate or move independent of outer circumferential surface 67A, for example, via a plurality of balls, spheres, other rolling structures 67C. Other bearing structures 67 may be used within the full spirit and scope of the present invention that may have different configurations that that shown in FIG. 7*c*. In any case, the bearing structure 67 of at least one embodiment is structured and configured to allow or facilitate the pendulum 30 to rotate independent of or relative to the housing 20 with reduced or minimal frictional resistance.

Figure 7A:
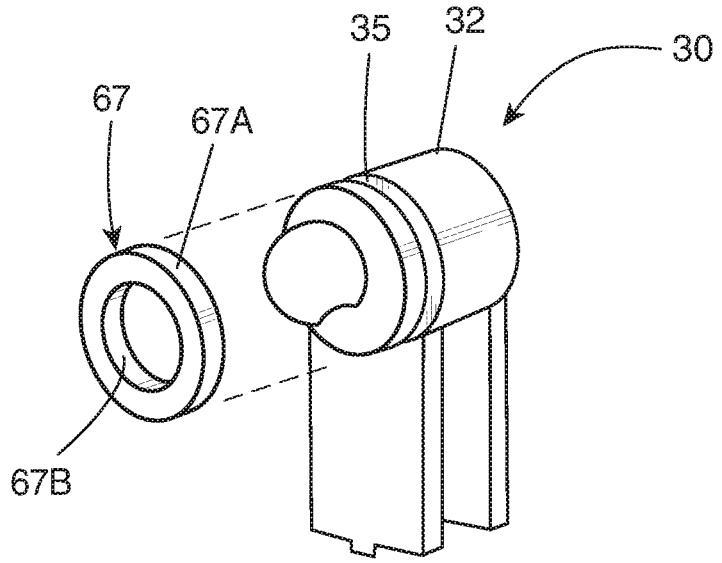
FIG. 7A is a partial exploded perspective view of the pendulum and an exemplary bearing structure as disclosed in accordance with at least one embodiment of the present invention.
Figure 7B:
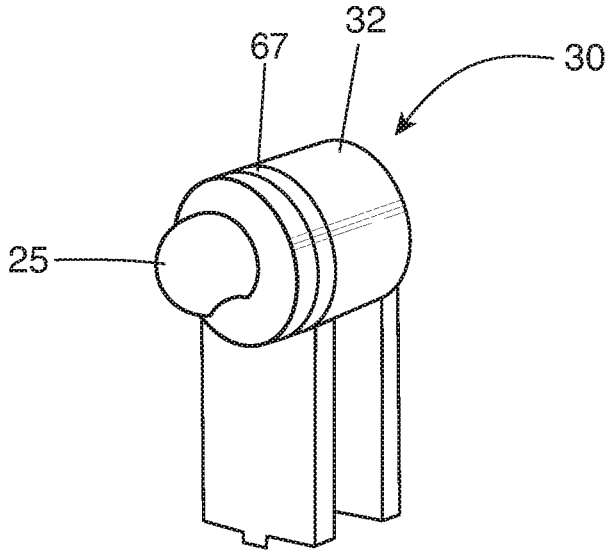
FIG. 7B is a perspective view of the embodiment illustrated in FIG. 7A, with the bearing structure seated within a circumferential groove.
Figure 7C:
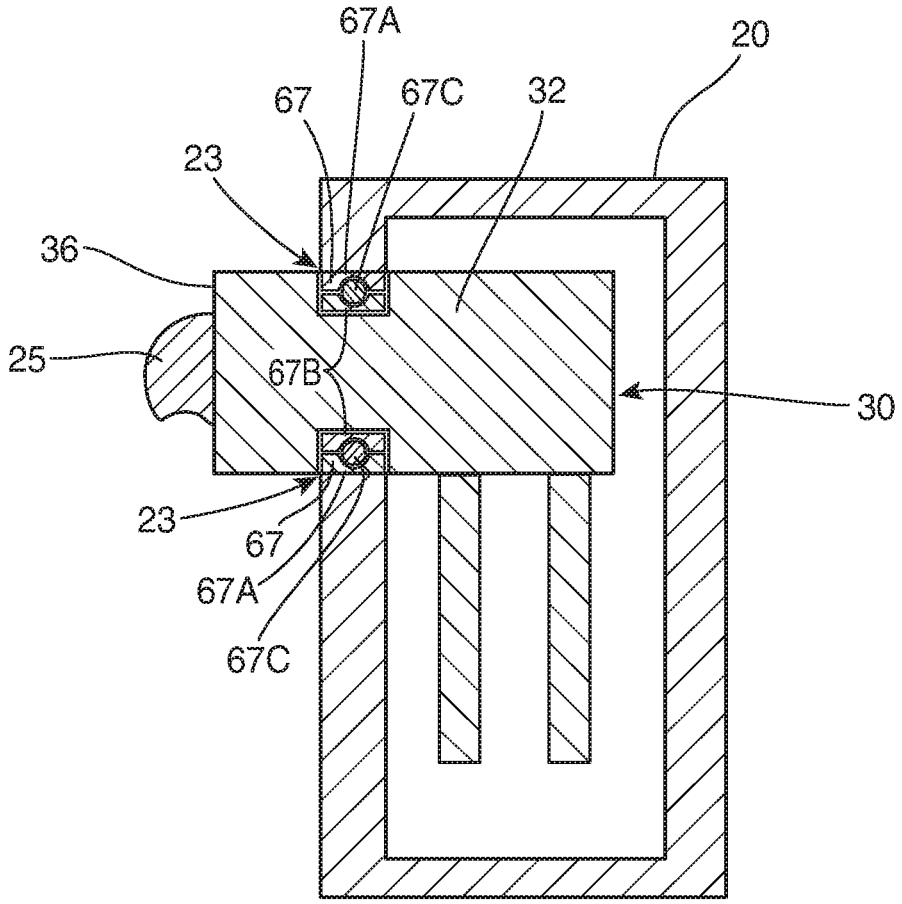
FIG. 7C is a sectional or cut-away view of the housing, pendulum and bearing structure as disclosed in accordance with at least one embodiment of the present invention.
Figure 8:
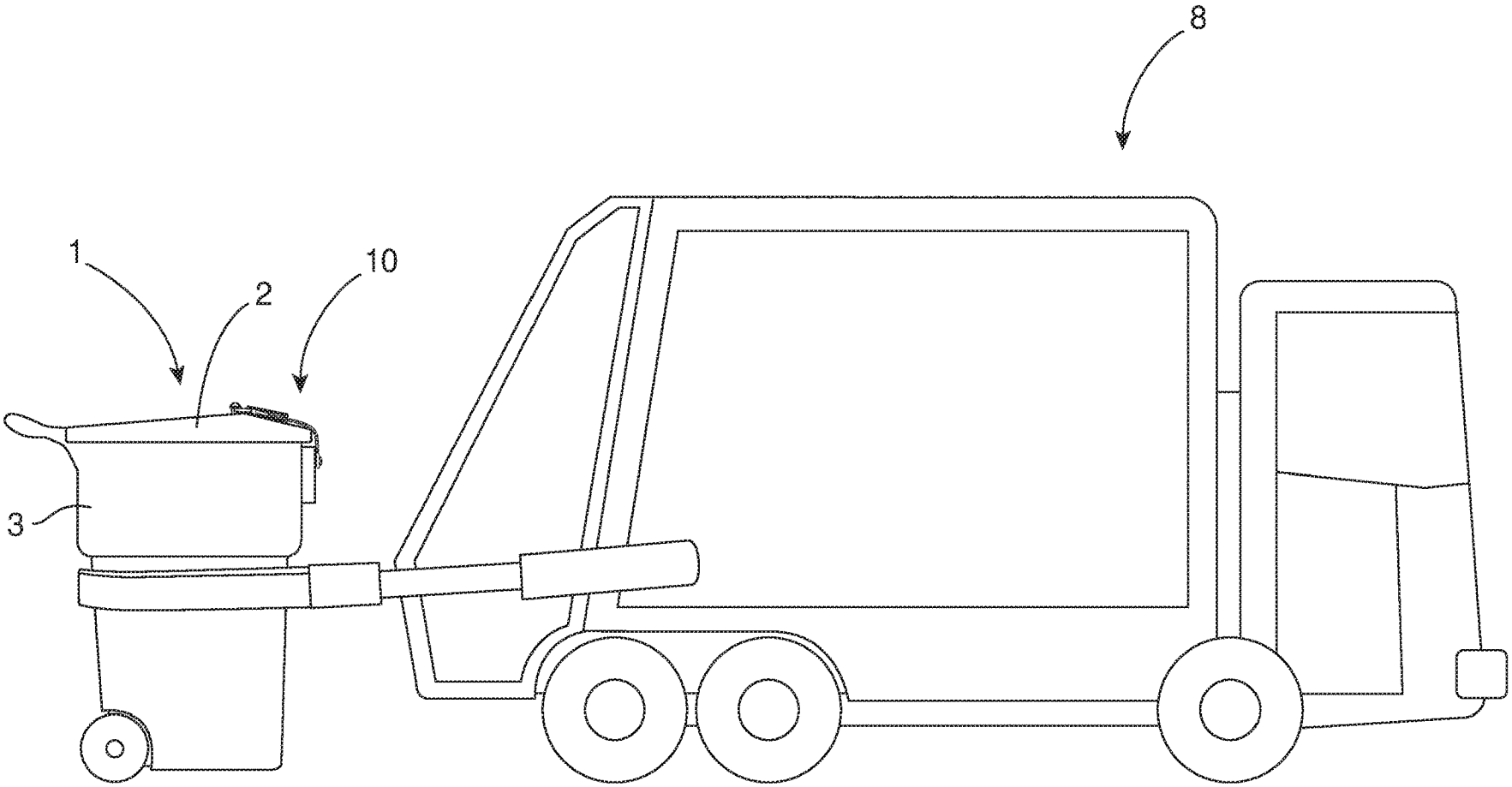
FIG. 8 is a side view of an automated garbage collection truck engaging an exemplary collection bin from the front, with the locking assembly disposed in the locked orientation.

Still referring to FIGS. 7A, 7B and 7B, in at least one embodiment, the bearing 67 is at least partially seated or disposed within a recess or groove 35 disposed around a portion of the pendulum aligned with opening 23 of the housing 20. For instance, main body 32 of the pendulum 30 may, in at least one embodiment, include a circumferential recess 35 disposed at least partially, but in some cases, completely around the main body portion 32. The bearing structure 67 may be at least partially or completely seated within the recess or groove 35 such that inner circumferential surface 67B of the bearing 67 is fixed to the pendulum 30 within the recess or groove 35.

For instance, the bearing structure 67 of at least one embodiment is disposed between the housing 20, e.g., the edge of the housing 20 defining the opening 23, and the portion of the pendulum 30 that extends through the opening 23. The bearing structure 67 facilitates rotational or swinging motion of the pendulum 30 by minimizing friction. The bearing structure 67 can be virtually any type of bearing capable of facilitating the intended rotation or swinging movement of the pendulum, including a ball bearing, roller bearing, roller-element bearing, plain bearing, etc.

Accordingly, the bearing structure 67 may be used to facilitate rotation or pivoting of the pendulum 30 relative to the housing 20, which may be fixed to the collection bin. In some embodiments, the pendulum 30 will pivot or rotate between two stoppers, such as stoppers A and B shown in FIG. 6.

Additional features of at least one embodiment include a cord 50 that has two sections referenced as a section 50A and a second section 50B. In at least one embodiment, first section 50A comprises lengthwise elasticity characteristic or is otherwise stretchable lengthwise, whereas the second section 50B is substantially inelastic lengthwise. As an example, the elastic section may be made of bungee or other similar cord while the substantially inelastic section may be made of nylon cord. Other materials are contemplated within the scope of the present invention.

In any event, the elastic section(s) 50A of at least one embodiment allows the cord 50, as a whole, to stretch and expand. This allows the cord 50 and locking assembly 10 to be used even in the event the trash or collection bin 1 is over filled. For example, if the trash or collection bin 1 is over filled, and the lid 2 is unable to completely close relative to the base of the bin 1, the locking assembly 10 of at least one embodiment can still be used to secure the lid down by stretching the cord 50, or by stretching the elastic section 50A of the cord 50 to temporarily extend the length of the cord 50.

The substantially inelastic section(s) 50B is/are, in most cases, kept in contact with the first support structure 25 and/or the second support structure 45 without compromising the functionality of the locking assembly 10. In other words, the elastic section(s) 50B of at least one embodiment are spaced from the first and/or second support structures 25, 45 while the inelastic section(s) 50B engage or contact the first and/or second support structures 25, 45, as described herein. Specifically, the substantially inelastic section(s) 50B of the cord 50 generally slip off of the first support structure 25 easier than an elastic section 50A. An elastic section 50A may tend to stretch first or stretch rather than slipping off of the first support structure 25. In addition, the elasticity of the elastic section 50A can generate additional friction or tension which may prevent or restrict it from slipping off of the first support structure as intended or as desired.

It should be noted, however, that in some embodiments, the entire cord 50 may have elastic or stretchable characteristic or the elastic section(s) may contact the first support structure 25 without degrading the function of the invention. Specifically, so long as the frictional forces on or between the cord support structures 25, 45 and the cord 50 are adequate enough to allow the pendulum 30 and second cord support structure or pulley 45 to rotate or otherwise function as intended within the scope of the various embodiments described herein. For example, the cord 50 may be coated with an agent or casing that reduces the friction even though it may be stretchable lengthwise.

In other embodiments, the entire cord 50 may be inelastic or substantially inelastic, again so long as the frictional forces on or between the cord support structures 25, 45 and the cord 50 are adequate enough to allow the pendulum 30 and second cord support structure or pulley 45 to rotate or otherwise function as intended within the scope of the various embodiments described herein.

Additional features or structures of at least one embodiment may include one or more sleeves or covers (not shown) attachable to the corner(s) or edges of the collection bin 1 upon which the cord 50 may engage or contact. For example, in some instances or implementations the cord 50 may engage or contact a front edge or corner of the lid 2 between the housing 20 and the second cord support structure 45. The cover(s) or sleeve(s) may snap onto, clip onto, be adhered to, or other connect upon the corner(s) or edge(s) thereby providing a barrier between the cord 50 and the bin 1. In this manner, the sleeves or covers may provide a smooth or surface with less frictional resistance than the corners or edges of the bin, thereby allowing the cord 50 to move more freely thereupon and thereby extending the life and durability of the cord 50.

Additionally, with reference to FIG. 3, the pendulum 30 of at least one embodiment pivots, rotates or swings in a direction that is substantially parallel to the support surface of the trash or collection bin 1 upon which the housing 20 is attached. More specifically, the pendulum 30 of at least one embodiment swings or pivots along a plane that is substantially parallel to the front of the trash or collection bin 1, when the housing 20 is secured to the front of the bin 1, as shown in FIG. 1A, for example. In other words, the pendulum 30 includes an axis of rotation referenced as A2 in FIGS. 1A and 1B that is substantially perpendicular to the support surface upon which the housing 20 is secured.

The configuration and operation of the pendulum 30 and other components of the locking assembly 10 of the present invention allow the locking assembly 10 to function properly and automatically unlock the lid regardless of the orientation in which the automated garbage collection truck 8 grabs the bin 1. For example, with reference to FIGS. 8 and 9, the garbage collection truck 8 is shown as grabbing the bin 1 from the front, wherein the lid 1 will swing open in a direction away from the truck 8 when the bin 1 is upended. FIGS. 10 and 11 show the garbage collection truck 8 grabbing the bin 1 from the rear, wherein the lid 1 will swing open in a direction toward the truck 8. In either case, gravity will cause the pendulum 30 of the present invention to swing along the predetermined path, causing the cord 50 to disengage from the first cord support structure 25, thereby allowing the lid 1 to swing open.

When the automated garbage truck 8 returns the trash or collection bin 1 to the curb or other location after collecting the trash or other contents, a user, e.g., a homeowner or business owner, can simply manually re-engage the cord 50 with the first cord support structure 25. This is because gravity will automatically cause the pendulum 30 to return to the first, resting position where the cord can be engaged within the groove 25A, as described herein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A collection bin locking assembly, comprising:

a housing defining an at least partially open interior portion, a pendulum at least partially disposed within said at least partially open interior portion of said housing, said pendulum being pivotally disposed between a first position and second position, a first cord support structure disposed external to said housing and rotatable with said pendulum, said first cord support structure comprising a groove disposed on a portion thereof and a smooth, outwardly curved surface adjacent said groove, a second cord support structure disposed in a spaced relation to said first cord support structure, a looped cord at least temporarily spanning between said second cord support structure and said groove of first second cord support structure, wherein, when said pendulum is pivotally disposed from said first position to said second position, said looped cord at least partially exits said groove of said first cord support structure and at least temporarily contacts said smooth, outwardly curved surface adjacent said groove until said looped cord is disengaged from said first cord support structure.

2. The collection bin locking assembly as recited in claim 1 wherein said pendulum comprises a main body and at least one outwardly extended leg.

3. The collection bin locking assembly as recited in claim 2 wherein a longitudinal axis of said pendulum is angularly disposed relative to a vertical axis when said pendulum is disposed in said first position.

4. The collection bin locking assembly as recited in claim 3 wherein said longitudinal axis of said pendulum is angularly disposed between 15 and 25 degrees relative to the vertical axis when said pendulum is disposed in said first position.

5. The collection bin locking assembly as recited in claim 3 wherein said pendulum further comprises at least one stopper structured to restrict pivotal movement of said pendulum within a predefined angular range.

6. The collection bin locking assembly as recited in claim 5 wherein said predefined angular range is between 60 and 70 degrees.

7. The collection bin locking assembly as recited in claim 3 further comprising a first fixed stopper and a second fixed stopper disposed in a spaced relation within the housing, said pendulum being pivotally disposed between said first fixed stopper and said second fixed stopper.

8. The collection bin locking assembly as recited in claim 1 wherein said first cord support structure is a hemispherical shape with said groove disposed on an underside thereof.

9. The collection bin locking assembly as recited in claim 1 wherein said looped cord comprises at least one elastic section and at least one substantially inelastic section.

10. The collection bin locking assembly as recited in claim 9 wherein said at least one substantially inelastic section of said looped cord is at least temporarily disposed in a contacting relation with said groove of said first cord support structure.

11. The collection bin locking assembly as recited in claim 10 wherein said at least one substantially inelastic section of said looped cord is disposed in a contacting relation with said second cord support structure.

12. The collection bin locking assembly as recited in claim 1 wherein said looped cord comprises a lengthwise elasticity.

13. The collection bin locking assembly as recited in claim 1 wherein said looped cord is movable relative to said first cord support structure.

14. The collection bin locking assembly as recited in claim 1 wherein said looped cord is movable relative to said first cord support structure and said second cord support structure.

15. The collection bin locking assembly as recited in claim 1 wherein said looped cord is movable relative to said housing, and wherein said looped cord is movable with at least a portion of said first cord support structure and at least a portion of said second cord support structure.

16. The collection bin locking assembly as recited in claim 1 wherein said pendulum pivots in a direction substantially parallel to a support surface of a collection bin, said housing being fixed to the support surface of the collection bin.

17. The collection bin locking assembly as recited in claim 1 wherein said pendulum comprises an axis of rotation that is substantially perpendicular to a support surface of a collection bin, said housing being fixed to the support surface of the collection bin.

18. A collection bin locking assembly for locking a trash bin lid to a trash bin body, said locking assembly being automatically unlocked when the trash bin is upended, said trash bin locking assembly comprising:

a housing defining an at least partially open interior portion, said housing being affixed to an external surface of the trash bin body, a pendulum at least partially disposed within said at least partially open interior portion of said housing, said pendulum being pivotally disposed between a first, resting position and second, unlocked position, a first cord support structure connected to said pendulum, said first cord support structure comprising a groove disposed on a portion thereof and a smooth, outwardly curved surface adjacent said groove, said housing comprising an opening allowing said first cord support structure to be connected to said pendulum and disposed at least substantially external to said housing, a bearing disposed at least partially within said opening to facilitate pivotal movement of said pendulum, a second cord support structure attached to the trash bin lid, a cord at least temporarily spanning between said second cord support structure and said groove of said first cord support structure, wherein said pendulum is gravity operated by being pivotally disposed from said first, resting position to said second, unlocked position when the trash bin is upended, wherein, when said pendulum is pivoted from said first, resting position to said second, unlocked position, said cord at least partially exits said groove of said first cord support structure and at least temporarily contacts said smooth, outwardly curved surface adjacent said groove until said cord is disengaged from said first cord support structure.

19. The collection bin locking assembly as recited in claim 18 wherein said pendulum is offset relative to a vertical axis when said pendulum is disposed in said first, resting position.

20. The collection bin locking assembly as recited in claim 18 wherein said pendulum pivots in a direction substantially parallel to the external surface of the trash bin body to which the housing is attached.

* * * * *